United States Patent [19]

Kata et al.

[11] 4,039,774

[45] Aug. 2, 1977

[54] PORTABLE HAIR DRYER

[75] Inventors: Joseph Kata, Meriden; Richard Ihasz, Milford, both of Conn.

[73] Assignee: Sperry Rand Corporation, Bridgeport, Conn.

[21] Appl. No.: 583,619

[22] Filed: June 4, 1975

[51] Int. Cl.[2] ..... H05B 1/00; F24H 3/04; A45D 20/10

[52] U.S. Cl. ..... 219/370; 34/97; 219/368; 219/373; 219/375; 338/57; 338/58

[58] Field of Search ..... 219/366–371, 219/373–376, 379–382, 364; 34/96–101, 243; 338/57, 58; 132/7, 9, 112

[56] References Cited

U.S. PATENT DOCUMENTS

| | | | |
|---|---|---|---|
| 1,809,458 | 6/1931 | Wahl | 219/364 |
| 2,133,188 | 10/1938 | Conforti | 219/370 X |
| 2,281,354 | 4/1942 | Hudson | 34/100 |
| 2,713,627 | 7/1955 | Kamataris | 219/366 X |
| 2,817,000 | 12/1957 | Scheid | 219/359 X |
| 3,132,232 | 5/1964 | Freedman et al. | 219/364 X |
| 3,383,700 | 5/1968 | Taylor | 219/370 X |
| 3,818,600 | 6/1974 | Fischer | 34/97 X |
| 3,885,127 | 5/1975 | Walter et al. | 219/370 X |
| 3,955,065 | 5/1976 | Chambon | 219/367 X |

FOREIGN PATENT DOCUMENTS

| | | | |
|---|---|---|---|
| 1,423,881 | 11/1965 | France | 219/370 |
| 384,687 | 11/1923 | Germany | 219/379 |
| 558,529 | 1/1944 | United Kingdom | 219/381 |

*Primary Examiner*—A. Bartis

*Attorney, Agent, or Firm*—Charles R. Miranda

[57] ABSTRACT

A portable hair dryer comprising an elongated casing of circular transverse cross-section and including a handle portion at one end an air discharge nozzle portion at the opposite end and an enlarged diameter intermediate section housing operative elements comprising a heater element and a motor driven fan for generating heated output air which is drawn from input air circulated by the fan through the heater element and outwardly through a discharge orifice provided in the nozzle portion. The motor, fan and heater element are supported on a common support member which is mounted on a single support element which comprises a base portion of the intermediate casing section which extends from the handle portion. The handle portion is separated from the base portion of said intermediate section by air intake vents through which said input air is drawn and in which handle is housed the switch and circuit control elements of the appliance.

8 Claims, 9 Drawing Figures

THERMOSTAT

Fig. 4.
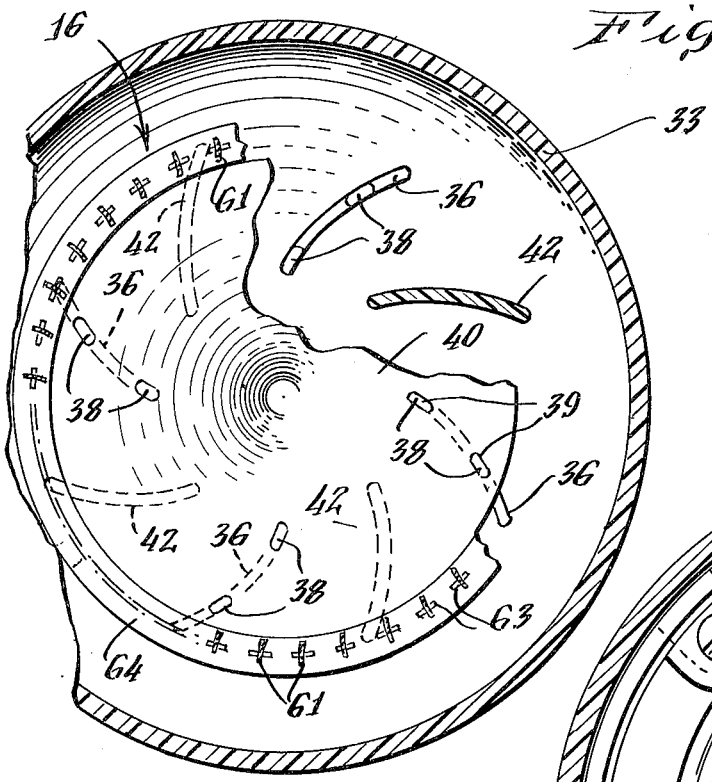
Fig. 5.
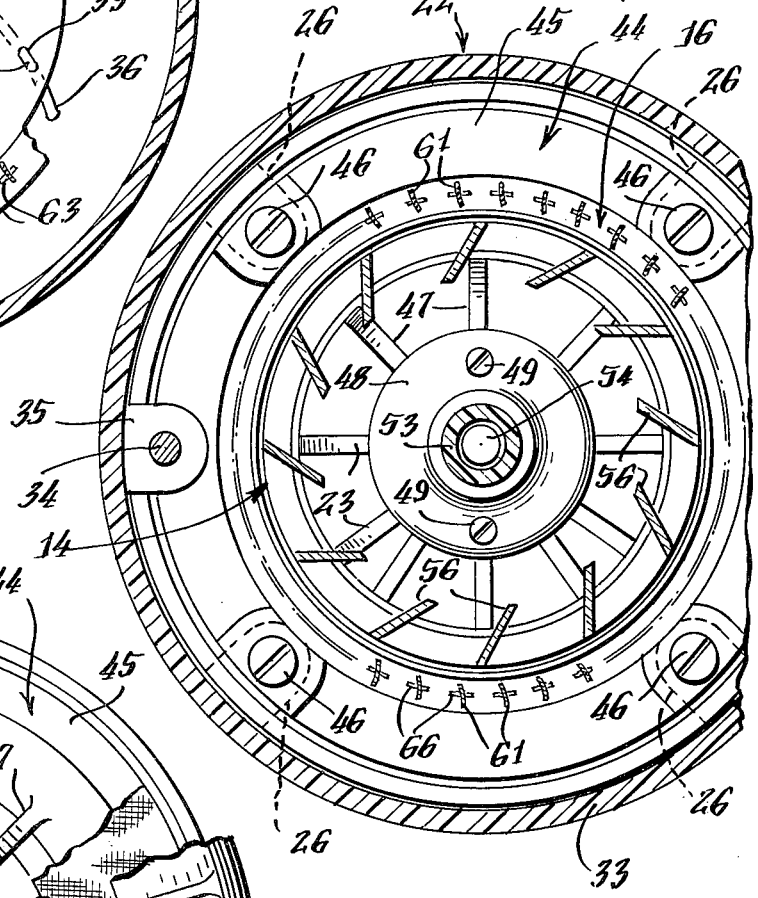
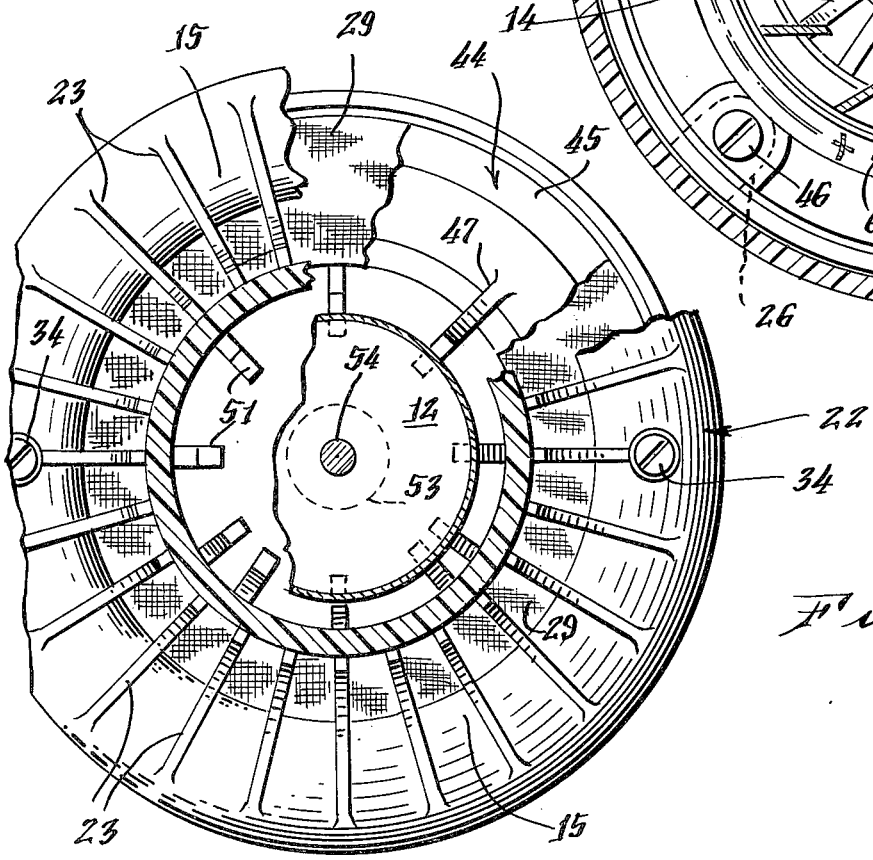
Fig. 6.

PORTABLE HAIR DRYER

BACKGROUND OF THE INVENTION

This invention relates to new and useful improvements in hair styling devices and more particularly to hand-held portable electric hair dryers.

Portable electric hair dryers of the type adapted for home and professional use are well-known and have enjoyed an ever increasing popularity among the public. These hair dryers are used to more effectively dry the hair of the user after washing and assist in the styling thereof thereby resulting in an appliance of much consumer desirability. In general these hair dryer devices include a casing having a portion formed as a handle to be held in the hand of the user and which casing is provided with an orifice for discharging heated air. The heated air is generated within the casing through utilization of a motor driven fan which circulates air drawn into the casing through a heater element. The fan further functions to direct the heated air outwardly of the casing through the discharge orifice.

In utilization of these devices the heat generated by the heater element is transmitted in part through the casing walls and therefore it is desirable that the heater element be positioned in the casing spaced from the handle portion. In some portable hair dryers the casing is provided with a gripping handle which is a separate casing attached to the dryer casing and spaced from the operating means of the dryer. In other dryers a single casing is provided with a portion thereof serving as a gripping surface.

Although these various designs of known hair dryers have met with varying degrees of success, certain inconveniences in use resulting from the structural arrangements of parts have been encountered. In those devices where the handle is separated from the main casing the user is required to utilize excessive manipulation of the casing in postioning the dryer for use. In other dryers where the casings are of an elongated configuration problems are encountered in arrangement of parts within the casing in a manner where the weight thereof is properly distributed so as not to cause discomfort to the user in manipulating the dryer. In addition, in the latter dryers it is desirable that the parts be arranged in a manner insuring efficient alignment of elements to simplify assembly procedures and provide for proper discharge of heated air from the casing.

It is the object of the present invention to provide a novel portable electric hair dryer.

Another object is to provide a hair dryer having novel means for receiving, circulating and distributing heated air to the hair of a user.

A further object is to provide means for efficient discharge of heated air and for allowing for expansion of the heater element in use.

Still another object is to provide a hair dryer having means for supporting the operative elements in assembled position in a novel structural arrangement resulting in improved assembly and manufacturing techniques.

A still further object is to provide a novel hair dryer having an elongated casing wherein means are provided for arranging the operating parts in aligned relationships for mounting in the appliance casing.

SUMMARY OF THE INVENTION

The present invention, comprehends a novel portable hair dryer. In the disclosed embodiment the appliance comprises an elongated casing having operative elements including a motor, fan and heater element. These operative elements are mounted in sub-assembled units on a common support member which is adapted for attachment to an enlarged base portion of the elongated casing. A cover member having air directing vanes is associated with the heater assembly and is fitted thereover and secured to the common supporting base of the appliance. The casing handle extends from the supporting base and is spaced therefrom by air intake vents. The handle has arranged therein the motor, switch and circuit establishing elements of the device.

The above and other objects and advantages of the present invention will appear more fully hereinafter from a consideration of the detailed description which follows taken together with the accompanying drawings wherein one embodiment of the invention is illustrated.

DESCRIPTION OF THE DRAWINGS

In the drawings:

FIG. 4 is a sectional view taken on the line 4—4 of FIG. 2;

FIG. 5 is a sectional view taken on the line 5—5 of FIG. 2;

FIG. 6 is sectional view taken on the line 6—6 of FIG. 2;

Figures 1, 2, 7:
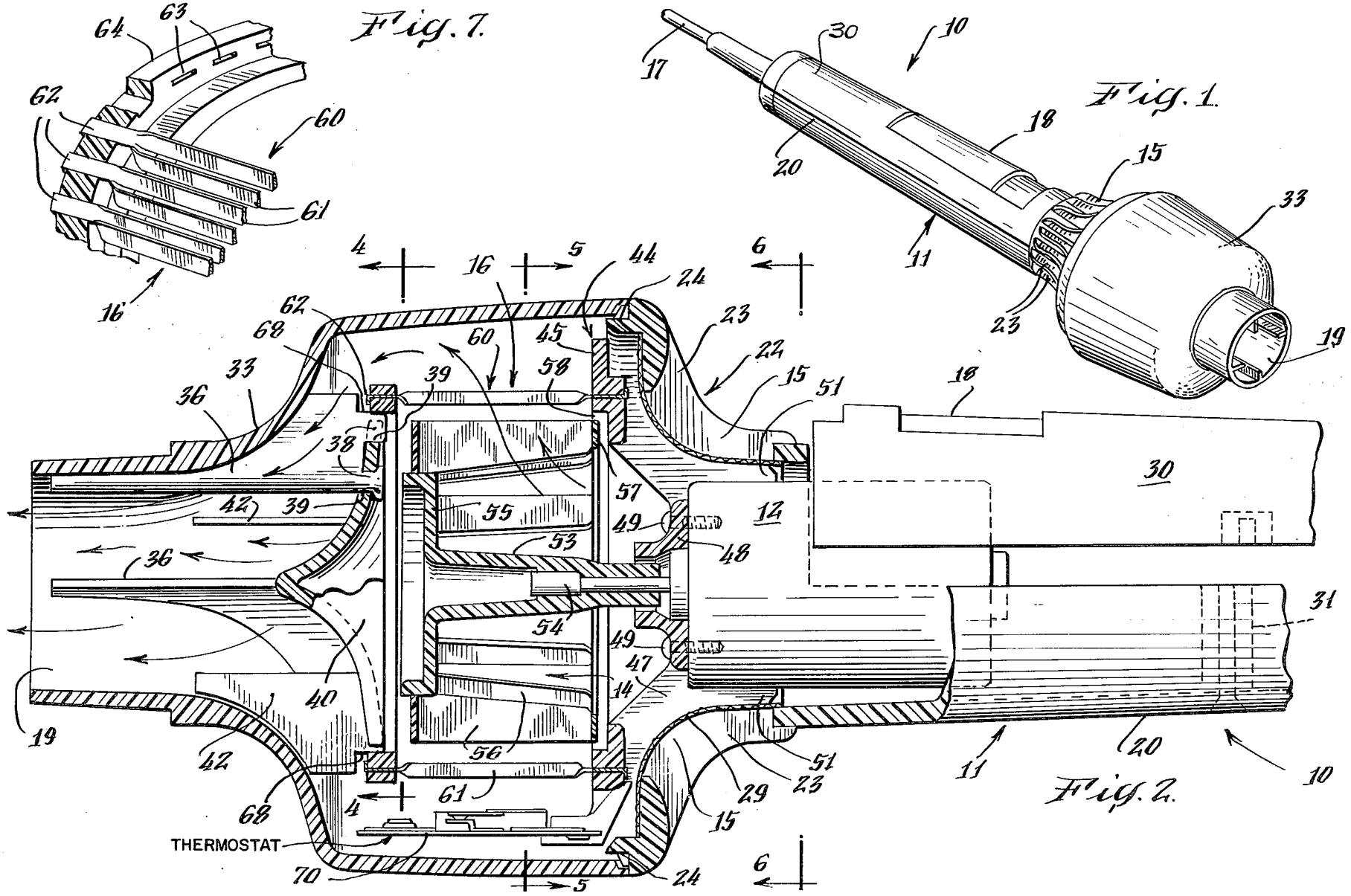
FIG. 1 is a perspective view of a portable electric hair dryer embodying the present invention.
FIG. 2 is a fragmentary side elevational view of the hair dryer of FIG. 1 with parts broken away to show the interior thereof.
FIG. 7 is an enlarged view of a portion of the heater element.

Referring now to the drawings for a more detailed description of the present invention and more particularly to FIGS. 1 and 2 a novel hair dryer made in accordance therewith is designated by the reference numeral 10. Hair dryer 10 comprises a generally elongated molded casing 11 of generally circular transverse cross-section in which are housed in operative relationship in a manner to be hereinafter explained in detail a motor 12, a fan 14 and a heater element 16. Dryer 10 is connectable to a suitable source of external power supply through power cord 17 in a usual manner. Upon operation of an on/off switch activator 18 fan 14 is rotated by motor 12 to draw air into casing 11 through air intake vents 15 provided in casing 11 and through the activated heater element 16 and outwardly of casing 11 through a discharge orifice 19.

Casing 11 is molded of a suitable hard premolded plastic material such as that sold under the trademark LEXAN. Casing 11 includes a main handle portion 20 and an enlarged forward base portion 22. Base portion 22 is separated from handle portion 20 by ribs 23 (FIG. 1) which provide therebetween said air intake vents 15. The inner leading portion of base 22 is provided with a shallow flanged area 24 (FIGS. 2 and 3) on which are provided screw fittings 26 (FIG. 5) for purposes to be hereafter described.

A screen member 29 open at opposite ends thereof is disposed in base portion 22 to cover intake vents 15 to prevent foreign material from entering the air intake vents 15 during operation of fan 14. In addition, a lid 30 is provided for handle section 20 and is secured thereto by a suitable screw and post assembly 31 (FIG. 2). Switch actuation 18 is slidably mounted on lid 30 in a suitable manner (not shown). Casting section 20 also houses the end of power cord 17 which is attached in electrical connection with the contacts of a switch operated by actuator 18 and other electrical components for operating motor 12 and for supplying electrical energy to heater element 16. These components do not form part of the present invention and may be of a usual type and have been omitted from the drawings for clarity.

Figures 3, 8, 9:
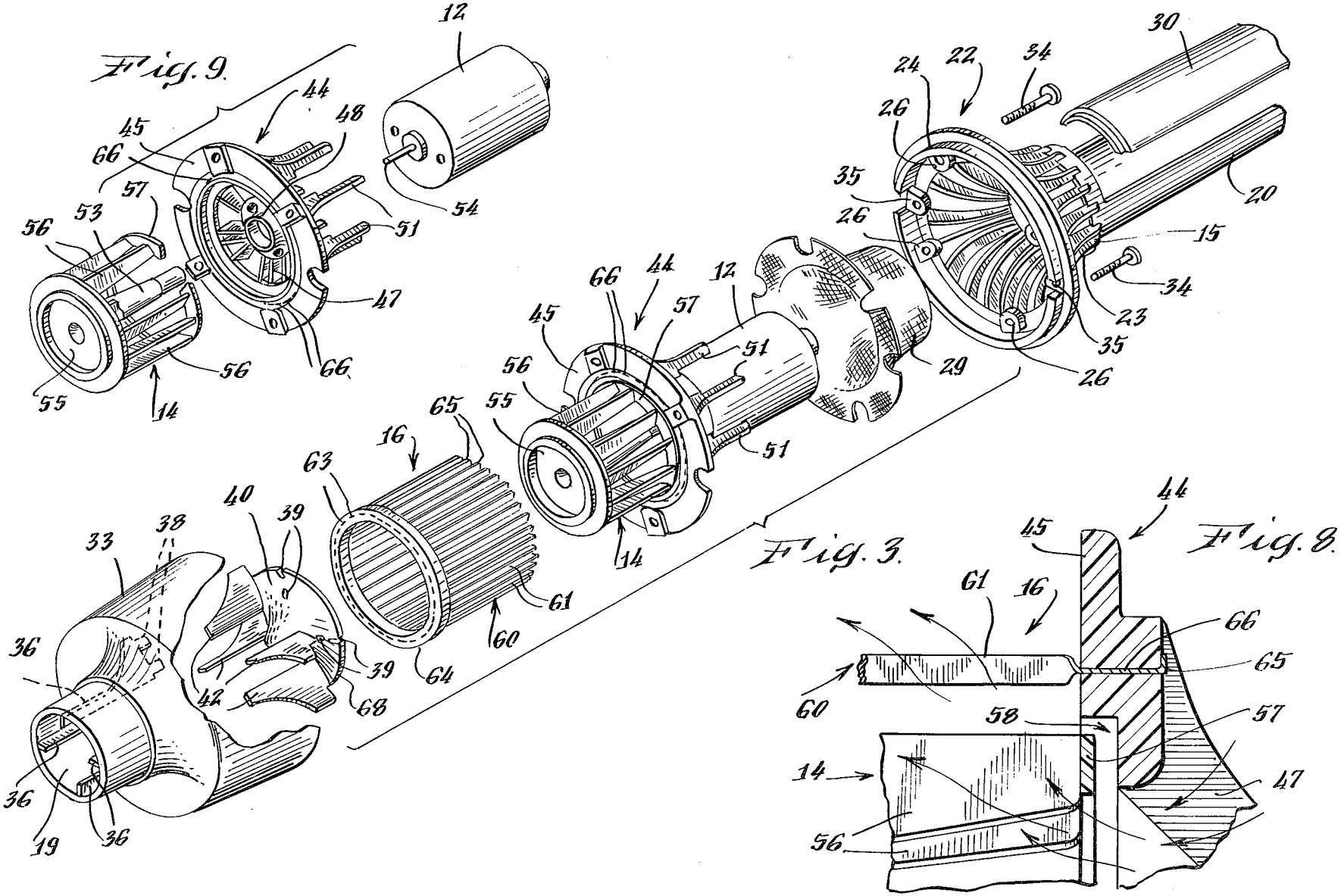
FIG. 3 is an exploded perspective view of the hair dryer.
FIG. 8 is an enlarged view of the portion of the fan and heater element showing a portion of the air distribution through the device.
FIG. 9 is an exploded view of the fan, motor and support member therefor.

Casing 11 is completed by a cover 33 provided over the front of casing 11 to form an enlarged internal casing area wherein is disposed heater assembly 16 and secured thereto by screws 34 (FIGS. 3 and 6) that pass through base portion 22 through opening 35 into cover 33. Four air directing vanes 36 are formed on the inner surface of cover 33 about air discharge orifice 19. Vanes 36 are provided with extension tabs 38 which are inserted into slots 39 of circular cone-shaped member 40 (FIGS. 3 and 4). Cone member 40 is provided with four vanes 42 complementary to vanes 36 on cover 33 and which vanes 36–42 in combination direct heated air from heater element 16 outwardly through discharge orifice 19.

As mentioned, it is a feature of the present invention to provide novel means for mounting the operative elements of the hair dryer, to wit, motor 12, fan 14 and heater element 16 in assembled position within casing 11 and for removal therefrom as an assembled unit. To this end there is provided support means which include a premolded plastic support member 44 (FIGS. 3 and 5). Support member 44 has a main disc portion 45 configurated to lie in flanged area 24 of base portion 22 and is secured thereto by suitable screws 46 (FIG. 5) passing through openings in disc 45 into fittings 26 in base 22. Ribs 47 extend from disc 45 to a circular bearing portion 48 which is fastened to the housing of motor 12 by screws 49. Positioning fingers 51 extend from bearing portion 48 and grip the outer surface of motor 12 to position motor 12 in casing 11 in the forward portion of handle 20.

Fan 14 is formed of molded plastic material and includes a hollow shaft member 53 which is press fitted on shaft 54 of motor 12. Hollow shaft member 53 extends from a base plate 55 and the free end is fitted for rotation in bearing housing 48 of support members 44. Fan 14 is of the centrifugal discharge type and is provided with a plurality of blades 56 extending from plate 55 to a rim 57 disposed for rotation in a circular channel 58 of support 44. An airstream or airflow path is established by fan blades 56 which draw air into dryer 10 through vents 15 and through the open central portion of support 44 (FIG. 2) to discharge the same about the periphery of the blades 56 to the heater element 16 as shown by flow arrows in FIG. 8 outwardly of casing 11 through air discharge orifice 16.

Heater element 16 comprises a circular shaped assembly disposed over fan 14. Element 16 comprises a foil resistance device 60 having individual interconnected flat elements 61. Each end 62 of elements 61 (FIG. 7) are fitted and held in opening 63 of a disc member 64. The opposite ends 65 (FIG. 8) of elements 61 are fitted in openings 66 on support member 44 and secured thereto by forming tabs 65. As seen in FIGS. 4 and 7, the elements 61 of foil 60 are arcuate-shaped to provide venting or air-turning means for air received from fan 14 and direct the same towards discharge orifice 19 via vanes 36-42. Disc 64 of heater element 16 adds to the rigidity thereof and rests on edge surfaces 68 (FIG. 2) of vanes 36 of cover 33.

In operation of hair dryer 10 with switch actuation 18 in on position air is drawn through air intake vents 15 through rotating centrifugal fan 14 outwardly of the periphery thereof through heater element 16 the foil element 61 of which direct the air heated thereby towards vanes 36–42 outwardly of orifice 19.

During operation of dryer 10 heater element 16 which is suitably connected to the electrical energy input in a usual manner is controlled by thermostat 70 which is set to interrupt the circuit to element 16 when a preselected internal temperature is reached. Further, in heated condition elements 61 of foil 60 may tend to expand. To allow for this thermal expansion disc 64 is free to move laterally (FIG. 2) on edges 68 of vanes 36 without disturbing the other elements of structure within dryer 10.

It will be apparent from the foregoing description that the advantages of the novel hair dryer includes among other advantages the provision of a compact arrangement of operative elements in position within dryer 10 and spaced from the handle portion 20. In the manner disclosed cover 33 can be removed fron base 22 by removal of screws 34 to expose the operative elements in assembled operative relationship. In this condition the motor 12, fan 14 and heating element 16 are aligned concentrically on a common support coincident with the central longitudinal axis of casing 11 thereby providing ease of assembly in manufacturing and repair procedures. The positioning of the operative elements at the approximate center area of the hair dryer 10 also provide for a balanced device which is comfortable to the user in operation. Further, the operative parts are spaced from the handle portion 20 so that no discomfort from the heat is transmitted to the hand of the user.

Although one embodiment of the present invention has been illustrated and described in detail it is to be expressly understood that the invention is not limited thereto. Various changes can be made in the design and arrangement of parts without departing from the spirit and scope of the invention as the same will now be understood by those skilled in the art.

What is claimed is:

1. A portable electric hair dryer comprising, a. an elongated casing of circular transverse cross-section and including a handle portion and an enlarged casing portion spaced from said handle, said enlarged portion positioned between air intake vents and an air discharge orifice formed in the walls of said casing;

b. means in said casing for establishing a heated airstream between said air intake vents and said air discharge orifice;

c. said airstream establishing means including a motor in said handle arranged adjacent said air intake vents and a fan driven by said motor for rotation within said enlarged casing portion and an elongated heater assembly having a central longitudinal axis and positioned in said enlarged casing portion in the path of said airstream between said fan and said discharge orifice;

d. said motor and fan having a common central longitudinal axis within said casting;

e. support means for said airstream establishing means comprising a support member of generally circular configuration secured to said enlarged casing portion between said air intake vents and said air discharge orifice, said support member having a central axis coincident with said common central longitudinal axis;

f. means formed on said support member and said heater assembly for supporting said heater assembly to said support member whereby said central longitudinal axis of the heater assembly is coincident with the axis of the support member and said common central longitudinal axis;

g. said support member having a bearing portion located centrally thereof and having a central axis coincident with said common central longitudinal axis ;

h. said bearing portion having means thereon for securing the motor and fan in coaxial relationship with said heater assembly; and i. said support member having a central opening to permit flow of air therethrough from said air intake vents in the direction of said common central longitudinal axis through said heater assembly to said air discharge orifice and outwardly of said casting upon operation of the fan.

2. The hair dryer of claim 1 wherein said means for supporting said heater assembly to said support member comprise spaced openings formed in said support member for receiving terminal elements of said heater assembly, said terminal elements having tab end portions extending through said openings for securing said heater assembly to said support member.

3. The hair dryer of claim 2 wherein said spaced openings comprise a circular array of closely spaced openings formed in said support member and said terminal elements comprise first end portions of a circular array of closely spaced interconnected resistive heater elements.

4. The hair dryer of claim 3 wherein said resistive heater elements have second ends spaced from said first ends in the direction of said air discharge orifice, said second ends being secured to a disc member adjacent said air discharge orifice and spaced from said support member, said casing further including air directing vanes adjacent said orifice, said vanes having surface portions engaging a portion of said disc member for slidable movement of said disc member relative to said directing vanes surface portions.

5. The hair dryer of claim 1 wherein said airstream establishing means further include spaced ribs in the central opening of said support member.

6. The hair dryer of claim 1 wherein said enlarged casing portion includes a detachable cover member carrying a plurality of circumferentially spaced air directing vanes extending to said air discharge orifice and a cone member positioned adjacent said fan between the fan and said air directing vanes, said cone member including a plurality of vanes positioned in spaces intermediates of said air directing vanes and said cone member vanes cooperating to direct heated air received from the heater assembly outwardly of the casing through said air discharge orifice.

7. A hand-held electric hair dryer comprising, a. an elongated casing of a circular transverse crossection;

b. a handle at one end of said casing;

c. an enlarged intermediate portion of said casing spaced from said handle end separated therefrom by air intake vents formed in said casing at the base of said enlarged intermediate portion and open to the interior of said enlarged intermediate portion;

d. an air discharge orifice formed in the opposite end of said casing and spaced from said enlarged portion by an axially inwardly tapering portion of said casing;

e. a motor disposed in said handle;

f. a fan interconnected to said motor and enclosed within said enlarged portion of said casing, said fan being operable by said motor for establishing an airstream into said casing from said air intake vents through said enlarged portion to said air discharge orifice and outwardly of said casing;

g. an elongated heater assembly arranged within said enlarged portion of said casing and interposed between said air intake vents and said air discharge orifice in the path of said airstream for heating said airstream;

h. a support member of a circularly-shaped configuration arranged within said enlarged portion of said casing for securing said motor, fan and heater assembly in concentrically aligned relationship with each other and coincident with the central axis of the elongated casing;

i. said support member being detachably secured to the base of said enlarged portion and having a bearing portion arranged centrally thereof and spaced from the base of said enlarged portion by radially inwardly extending rib portions on said support member;

j. said rib portions forming therebetween openings in said support member to permit flow of air therethrough from said air intake vents in the direction of said common central axis through said heater assembly to said air discharge orifice and outwardly of said casing upon operation of the fan; and k. said motor and said fan being secured to said bearing portion in assembled relationship with said heater assembly which is secured to said support member, said assembled motor, fan and heater assembly being removable from said casing as an operative unit.

8. A hand-held electric hairdryer comprising, a. an elongated casing with a longitudinal axis having a circular transverse cross section and being substantially of uniform diameter except adjacent one end where the diameter of the casing is larger to form an enlarged casing portion;

b. said portion of the casing between the enlarged casing portion and the other end of the casing being shaped and constructed to serve as a handle providing for manual manipulation of the casing ;

c. a plurality of air intake vents formed in the casing at the juncture of said enlarged casing portion and said handle portion to permit passage of air from outside the casing into the enlarged casing portion;

d. an air discharge orifice formed at said one end of the casing and in communication with the interior of said enlarged casing portion;

e. a motor disposed in said handle portion and having the output end of its shaft extending into said enlarged casing portion;

f. a fan mounted on said motor shaft for rotation and arranged within said enlarged casing portion to establish an airstream into said elongated housing through said air intake vents, then through said enlarged casing portion, and out said air discharge orifice;

g. a support member disposed within the enlarged casing portion adjacent the end of said enlarged casing portion near said air intake vents and having a portion seated against rotation relative to the elongated casing;

h. an elongated heater assembly heater assembly disposed within said enlarged housing portion and having one end thereof engaging said support member to be held thereby against rotation, said heater assembly being located between said air intake vents and said air discharge orifice and in the path of said airstream to heat said airstream;

i. the support member further having a bearing portion arranged centrally thereof for mounting the motor thereto and provided with spaced ribs extending radially between the bearing portion and the support member seated portion, said ribs being provided in the path of the airstream between the blades of said fan and said air intake vents;

j. said support member supporting and engaging said motor, said fan, and said heater assembly so as to maintain them in concentrically aligned relationship with each other and coincident with the longitudinal axis of the elongated housing; and k. said support member further interconnecting said motor, said fan, and said heater assembly in an assembled relationship to provide for easy assembly to and removal from the handle portion of the elongated casing.

* * * * *